United States Patent [19]

Smolnik

[11] Patent Number: 4,827,846

[45] Date of Patent: May 9, 1989

[54] INITIATING DEVICE FOR A TRAINING PROJECTILE

[76] Inventor: John Smolnik, 81 Leamoor Dr., Parsippany, N.J. 07054

[21] Appl. No.: 111,599

[22] Filed: Oct. 23, 1987

[51] Int. Cl.[4] ..... F42B 13/22

[52] U.S. Cl. ..... 102/445; 102/256; 102/258; 102/272; 102/498; 102/500; 102/529

[58] Field of Search ..... 102/254, 256, 258, 259, 102/272, 274, 275, 445, 499, 500, 513, 498, 334, 529

[56] References Cited

U.S. PATENT DOCUMENTS

| | | | |
|---|---|---|---|
| 3,291,048 | 12/1966 | Lubblers | 102/445 |
| 3,407,734 | 10/1968 | Tabor | 102/500 |
| 3,576,165 | 4/1971 | Gawlick | 102/258 |
| 3,623,432 | 11/1971 | Schminke | 102/259 |

*Primary Examiner*—Harold J. Tudor

[57] ABSTRACT

An initiating device which employs discardable arming members is disclosed. The design qualifies as a low cost, responsive, impact initiating system for a practice projectile. The method is embodied in a sub-caliber flight projectile as part of a mortar training device.

9 Claims, 3 Drawing Sheets

INITIATING DEVICE FOR A TRAINING PROJECTILE

FIELD OF THE INVENTION

The present invention relates to an initiating device for a practice projectile. In particular the invention is suited for application in a practice subprojectile as part of a mortar training device. The mortar training device is of a same general type as the subject matter of my earlier invention, U.S. Pat. No. 4,711,180, dated Dec. 8, 1987.

BACKGROUND OF THE INVENTION

A mortar training device utilizes a fuzed subprojectile containing a percussion cap and spotting charge. The subprojectile and a propelling charge are assembled within a full size dummy projectile having a subcaliber bore. The training device resembles a service mortar cartridge and is dropped fired into a mortar in the same manner as with service ammunition. The dropped training device strikes a firing pin at the base of the mortar to initiate a propelling charge. The charge propels the subprojectile into a trajectory downrange while ejecting the dummy projectile a few yards from the mortar. The subprojectile impacts the ground to initiate the percussion cap which in turn ignites the spotting charge. The distance of impact is approximately one-tenth the distance of service ammunition. The training device is intended to provide realistic mortar firing training, at low cost, using standard mortar, standard sighting and fire control equipment and a special firing table in the same manner as standard service mortar ammunition.

A current design for initiating the spotting charge in the subprojectile includes an internally housed plunger in which the percussion cap is mounted. Upon projectile impact, the plunger slides forward causing the percussion cap to strike a firing pin.

The plunger is firmly held in a rearward seated position during handling and launch by radially emplaced balls within throughholes in walls of the subprojectile with the balls partially extending into a recess in the plunger. The balls are held in place by an overlying cartridge during handling and by the bore during launch. The balls discard from the subprojectile upon clearing the bore.

The design relies on impact deceleration of the subprojectile together with an inertial mass of the percussion cap plunger to provide the necessary striking impulse for initiating the percussion cap. A disadvantage of the design is that the striking impulse thusly generated is low, and occurence of dud projectiles are often encountered during practice firing exercises.

The above design appears to provide a requisite safety in handling and reliability in arming, but there is a need to reduce incidence of duds.

PURPOSE OF THE INVENTION

It is the object of this invention to provide a practice projectile with a low cost, safe handling, arming and initiating device having improved initiation reliability.

SUMMARY

The present invention provides an initiating device for a practice projectile comprising a slidable plunger, an external portion of the plunger forming the nose of the projectile, a firing pin fixed at the rear of the plunger, a spring to bias the plunger toward a forward position, a housing for the plunger, a percussion cap mounted aft of the plunger, a discardable arming insert interposed between facing members of the plunger and housing to limit rearward movement of the plunger, the insert of sufficient axial thickness to prevent the firing pin from contacting the percussion cap, an insert retaining means in which the plunger must displace itself forward to free the insert for radial discard, a locking means to retain the plunger in a rearward axial position abutting the insert during handling, and a case to retain discardable components during handling.

Arming of the projectile occurs after the projectile emerges from the bore and the locking means are disabled. Upon full emergence from the bore, projectile acceleration essentially ceases. Spring force now is able to displace the plunger forward. Such forward displacement frees the insert for radial discard. With the insert removed, the plunger remains under spring restraint until impacting the ground or target. Upon impact, the plunger is driven rearward to initiate the percussion cap, the cap in turn initiating a spotting charge.

Thus, the design provides for a highly responsive, directly driven, firing pin initiation method, made feasible by a novel design and arrangement of discardable arming inserts.

DESCRIPTION

Figure 1:
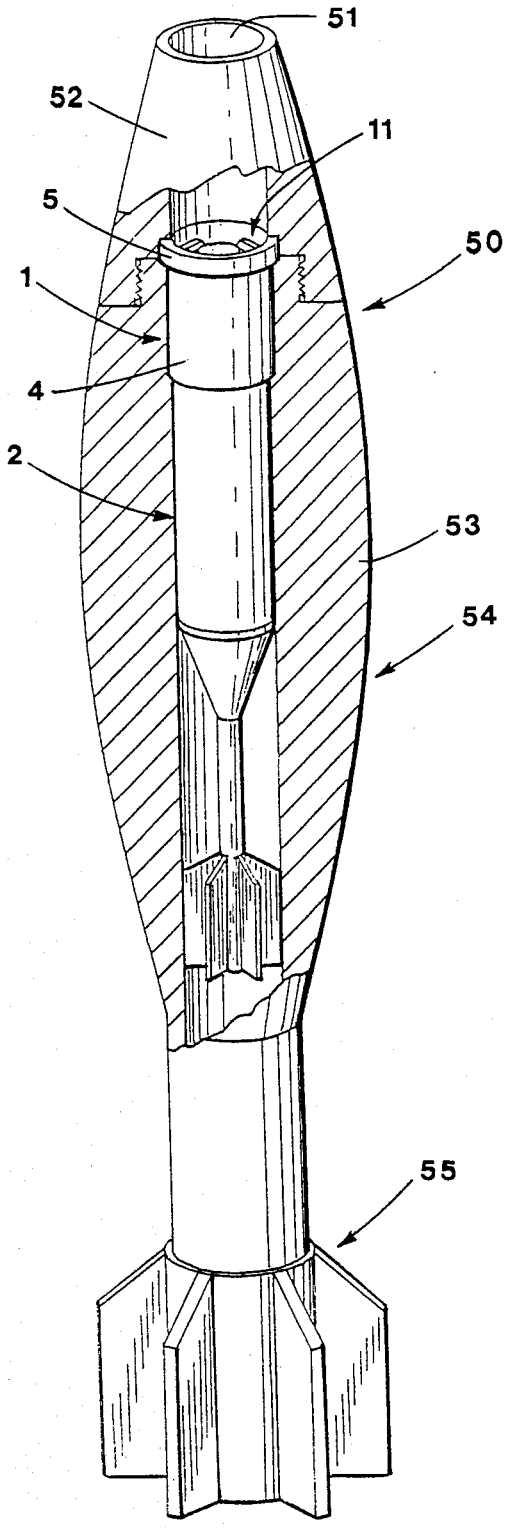
FIG. 1 is a perspective view of a subprojectile cartridge according to the present invention shown housed within a mortar training device.

FIG. 1 shows an overview of a subsystem in which the current invention qualifies for implementation. Mortar training device 50 is shown comprising dummy projectile 54 and subprojectile practice cartridge 1, the latter according to the preferred embodiment of the invention. Device 50 resembles a standard mortar cartridge and is used in training exercises for a mortar gunner and crew including forward observers. Device 50 includes a nose 52, bore 51, midsection 53 and tail section 55. Cartridge 1 includes subprojectile 2 and case 4. Case 4 is shown as a stub case having flange 5. A portion of discardable arming inserts 11 are visible, and are shown enclosed by case 4 at a forward portion of subprojectile 2. Flange 5 seats on midsection 53 while nose 52 retain cartridge 1 in dummy projectile 54.

Gunner training includes drop firing of training device 50 in a mortar weapon. A firing pin of the weapon initiates propelling charges (not shown) located in tail section 55. Charge gases propel subprojectile 2 out of bore 51 into a flight trajectory. A portion of the charge gases also expel dummy projectile 54 from the weapon. Following training exercises, dummy projectiles 54 are collected for reloading and reuse. Flange 5 facilitates the extraction of case 4 during reloading operations.

In an alternative embodiment of device 50, practice cartridge 1 would include a longer case 4 extending rearward over subprojectile 2 with an aft adjunct of case 4 configured to contain the propelling charges. As such, cartridge 1 would be assembled to dummy projectile 54 via tail section 55. Flange 5 would be relocated to an aft location on case 4. A means of retaining cartridge 1 would be included in tail section 55 of dummy projectile 54. Thus reloading of dummy projectile 54 at a training site would be facilitated in that the propelling charges need not be reloaded apart from subprojectile cartridge 1.

Figure 2:
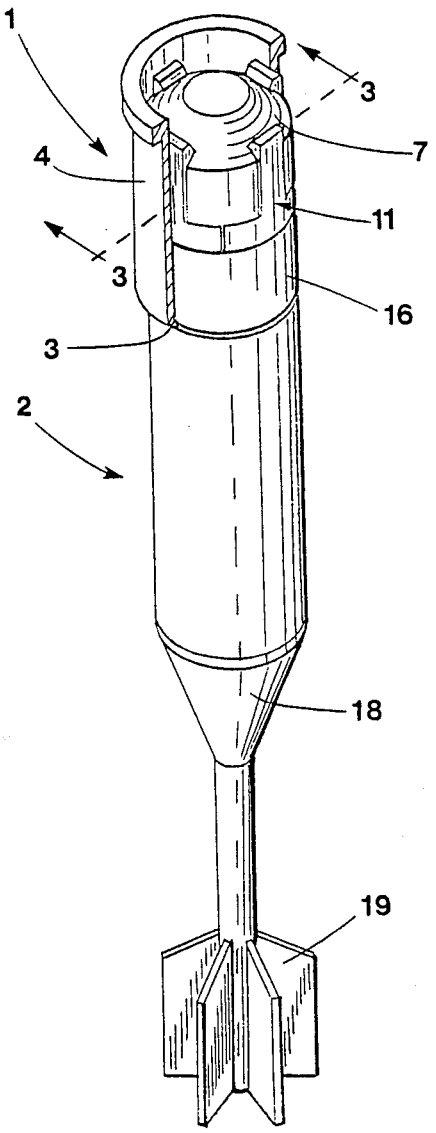
FIG. 2 is a perspective view of the subprojectile cartridge in partial section showing placement of discardable arming inserts.

Referring to FIG. 2, a portion of case 4 of cartridge 1 is cut away to reveal discardable arming inserts 11 and crimp 3 of case 4. Crimp 3 is shown as a means of attaching case 4 to subprojectile 2. Other major members of subprojectile 2 include firing plunger 7, housing 16, base 18 and fins 19.

Figure 3:
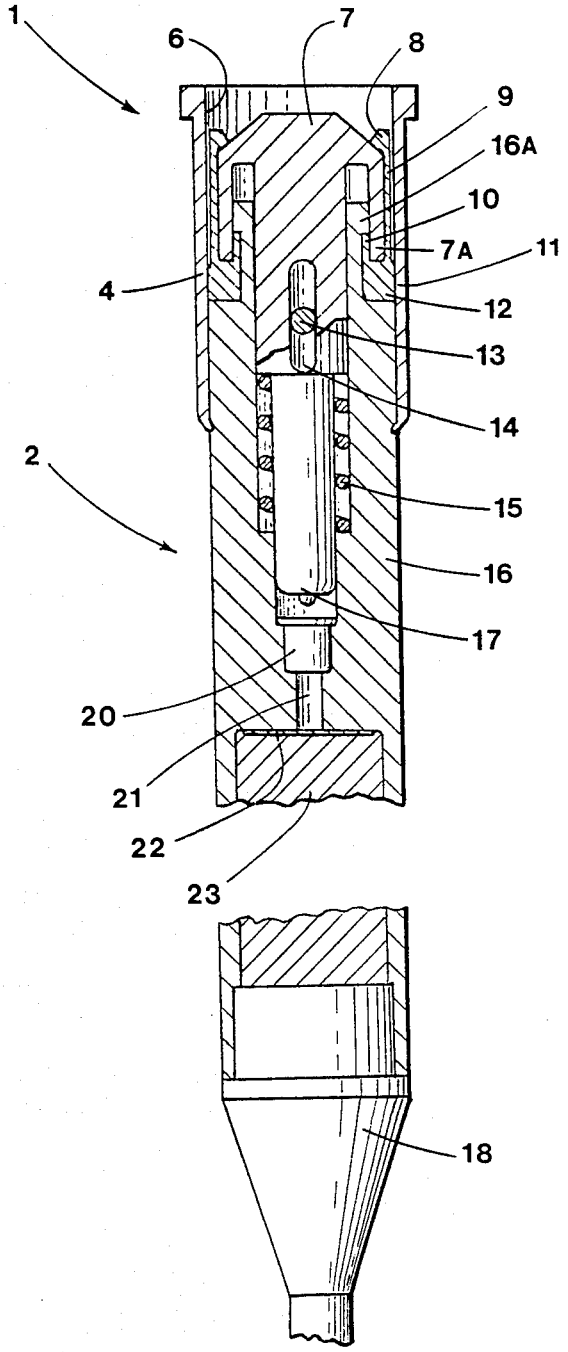
FIG. 3 is a partial sectional view of the cartridge taken along 3—3 of FIG. 2.
Figure 4:
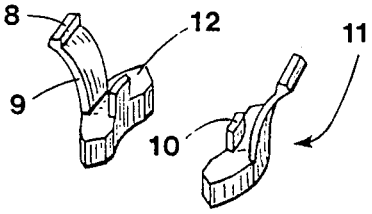
FIG. 4 is a perspective view of the discardable arming inserts according to the present invention.

Components of cartridge 1 are best described by referring to FIG. 3 and by referring to each major component in a sequence corresponding to a probable sequence of assembly. Percussion cap 20 is first seated and retained in housing 16. Firing plunger 7 including firing pin 17 is assembled with spring 15 and slidingly inserted in housing 16 against a force exerted by spring 15. Rod 13 is transversely assembled through, and affixed to, holes (not shown) of housing 16 while slidably passing through slot 14 of plunger 7. Spring 15 now tends to force plunger 7 to a forward position (not shown) in housing 16. Rod 13 limits forward travel of plunger 7 on contact with an aft edge of slot 14. One or more arming inserts 11 are radially emplaced in housing 16. Plunger 7 is then forced rearward with plunger collar 7A abutting chock 12 of insert 11. Plunger 7 axial position is then as shown in FIG. 3 with rod 13 approximately centered in slot 14. In this position, collar 7A radially retains insert 11 via insert lug 10 while chock 12 stands off plunger firing pin 17 from contact with percussion cap 20. Insert extension 9 is a springy member normally sprung radially outward (FIG. 4). Grip 8, shown at a forward edge of extension 9, is forced radially inward to abut a forward edge of plunger 7. Case 4 is slipped over subprojectile 2 and crimped thereon to radially retain grip 8 of insert 11. Grip 8 cooperatively with housing ledge 16A and lug 10 precludes forward movement of plunger 7 with respect to housing 16 while under radial restraint by inner diameter 6 of case 4.

Arming inserts 11 are illustrated in greater clarity in FIG. 4 showing constituent members chock 12, lug 10, extension 9, shown in a sprung mode, and grip 8.

Remaining components of subprojectile 2, as shown in FIG. 3, are seal 22, spotting charge 23, and flash port 21 for passage of percussion cap 20 gases to initiate charge 23. Charge 23 is loaded through an open aft end of housing 16. Base 18 retains charge 23 in housing 16. Upon initiation of charge 23, base 18 separates from housing 16 for discharge of spotting charge 23 effluent.

Figure 6:
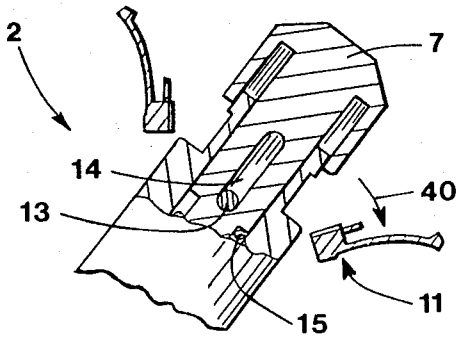
FIG. 6 is a partial sectional view as in FIG. 5 of the subprojectile in an armed position after emerging from the training device.
Figure 5:
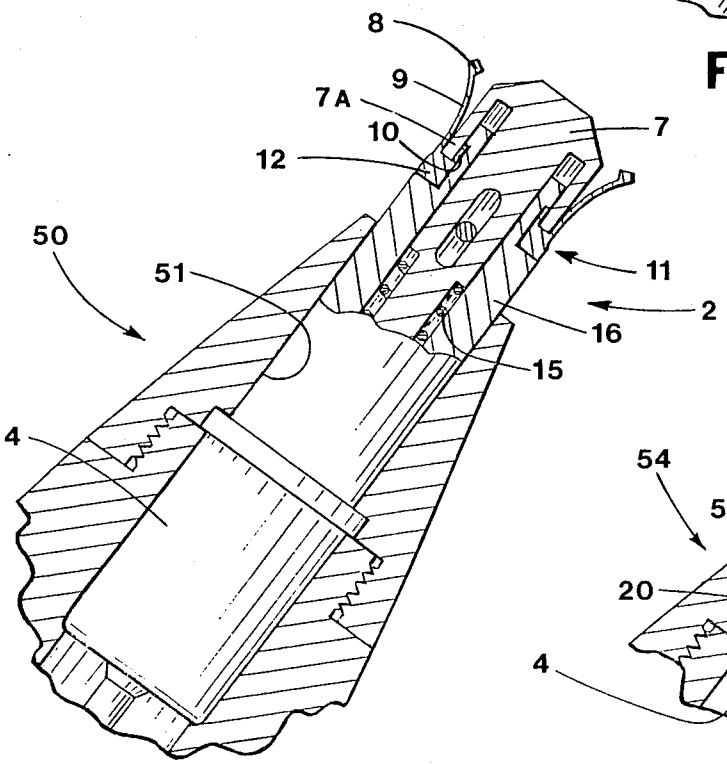
FIG. 5 is a partial sectional view taken along a longitudinal axis of a subprojectile according to the invention. The subprojectile is shown emerging from a bore of the training device.

Arming of subprojectile 2 is shown in a sequence illustrated by FIG. 5 and FIG. 6. Referring first to FIG. 5, upon drop firing device 50 and initiating a subprojectile propelling charge, subprojectile 2 is dislodged from case 4 by a force of propelling gas pressure acting on the subprojectile. As a forward portion of subprojectile 2 emerges from bore 51, extension 9 of discardable insert 11 springs radially outward, disengaging grip 8 from plunger 7. Plunger 7 is now unlocked for forward movement relative to housing 16. However, subprojectile 2 is still partially inbore and accelerating due to propelling gas force. A rearward force due to acceleration of plunger 7 mass predominates over a forwardly directed force exerted by spring 15 thus precluding forward movement of plunger 7 while subprojectile 2 is accelerating. Since plunger 7 remains seated on chock 12 while subprojectile 2 is transitionally emerging from bore 51, collar 7A radially retains lug 10 and insert 11 does not discard.

FIG. 6 illustrates subprojectile 2 after fully emerging from bore 51 (FIG. 5) and no longer under influence of propelling gases. Spring 15 force overcomes an aerodynamic force on plunger 7, moving plunger 7 forward. Rod 13 in slot 14 limits forward movement of plunger 7 to a position shown in the figure. Insert 11 is thus free of radial restraint and is aerodynamically dislodged from subprojectile 2 along path 40. Subprojectile 2 is now armed and plunger 7 is free to move fully rearward upon ground impact to initiate percussion cap 20 (FIG. 3).

Figure 7:
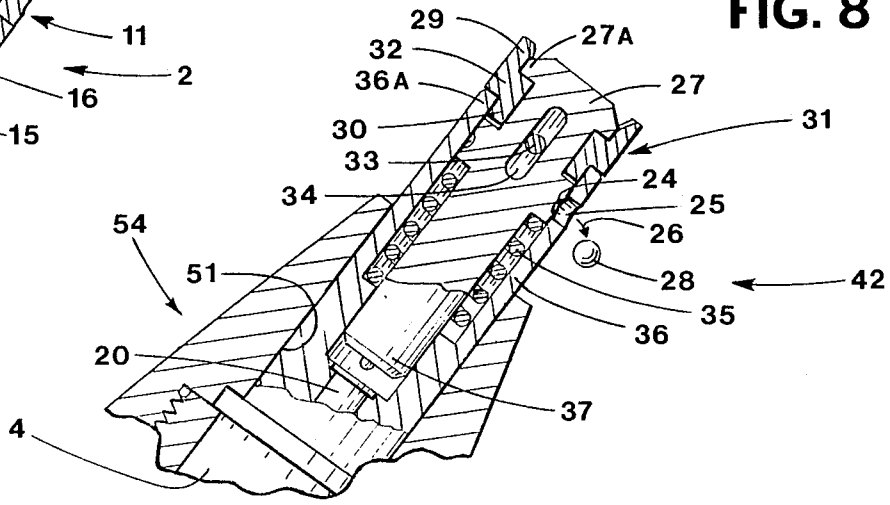
FIG. 7 is a partial sectional view taken along a longitudinal axis of an alternate embodiment of a subprojectile according to the invention. The alternate subprojectile is shown emerging from the training device.

An alternate embodiment of a subprojectile according to the invention is shown in FIG. 7. Subprojectile 42 is shown partially emerged from bore 51 in a similar posture as subprojectile 2 (FIG. 5).

A cartridged configuration of subprojectile 42 is not shown. However, FIG. 7 suffices to reconstruct such cartridge configuration for the alternate subprojectile as follows. Case 4 envelopes subprojectile 42 and is affixed thereto as with subprojectile 2 (FIG. 3). Ball 28 is located in radial hole 25 of housing 36. A portion of ball 28 intrudes into depression 24 of plunger 27. Case 4 radially retains ball 28 in both hole 25 and depression 24 thereby preventing axial movement of plunger 27 relative to housing 36. Spring 35 is partially compressed thus exerting a forwardly directed force on plunger 27. Discardable arming insert 31 is radially emplaced in subprojectile 42 interposed between plunger ledge 27A and housing 36. Chock 32 stands off firing pin 37 from contact with percussion cap 20. Housing rim 36A radially retains insert 31 via insert lug 30. Rod 33 and length of slot 34 limit ultimate travel of plunger 27.

Still referring to FIG. 7, an initial arming stage of subprojectile 42 is shown. Subprojectile 42 is illustrated emerging from bore 51 of dummy projectile 54 and still accelerating under influence of propelling gas pressure. Ball 28, now free of case 4 and bore 51 radial restraint, is shown dislodged from plunger depression 24 and hole 25, dropping out of hole 25 approximately along path 26. Plunger 27, although unlocked for forward movement, remains seated on chock 32 due to acceleration forces. Thus housing rim 36A retains insert 31 via lug 30 from radial discard while subprojectile 42 is transitionally emerging from bore 51.

Figure 8:
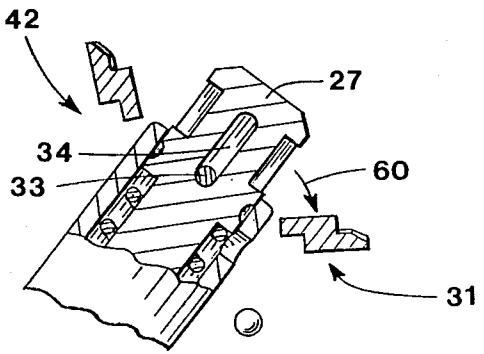
FIG. 8 is a partial sectional view as in FIG. 7 of the alternate embodiment of the subprojectile in an armed position.

FIG. 8 illustrates subprojectile 42 after fully emerging from bore 51 (FIG. 7) and no longer under influence of propelling gases. Spring 35 force moves plunger 27 forward. Rod 33 in slot 34 limits plunger 27 forward movement to a position shown. Insert 31, now free of radial restraint, is aerodynamically dislodged from subprojectile 42 approximately along path 60. Subprojectile 42 is now armed, and plunger 27 is free to initiate percussion cap 20 upon ground impact.

While the description claims many specificities, these should not be construed as limitations on the scope of the invention, but rather as an exemplification of the specific embodiments thereof.

Many other variations are possible. For example, a locking means for preventing forward movement of the plunger relative to the housing in the alternate embodiment of FIGS. 7–8 may be made similar in principle to that of the preferred embodiment of FIGS. 1–6 as follows. Remove a radial ball intrusion structure shown in FIGS. 7–8 comprising ball 28, radial hole 25 and depression 24. Replace with a structure comprising a radially flexible arm joined to insert 31, the arm extending rearward within an external channel of housing 36, an inwardly projecting grip member at an extremity of the arm, the grip member adjacent to a mating indentation in housing 36 to radially receive the grip member. With the latter structure under radial case or bore restraint, the plunger is arrested from axial movement.

Other locking means are feasible, including means which are not joined to the discardable inserts but which simply consist of grips coupled to an arm, each grip radially emplaced into an indentation in the plunger and in the housing to arrest axial movement of the plunger when the grips are held in place under radial restraint of the case or bore.

Furthermore, the invention may be embodied in a full caliber projectile, or even one which is spin stabilized rather than statically stabilized. The invention may also be applied to a rocket propelled projectile in which rocket burning begins prior to muzzle exit and ends prior to impact.

Accordingly, the scope of the invention should be determined not by the embodiments illustrated, but by the appended claims and their legal equivalents.

What is claimed is:

1. An arming and initiating device for a practice projectile, said device comprising:

a case circumferentially enclosing a fore section of said projectile, an internal caliber of said case similar in size to a bore of a firing piece for said projectile, a means for retaining said case in said firing piece during propulsive launch of said projectile;

a firing plunger, a portion of said plunger extending to a foremost position in said projectile fore section;

a housing for said plunger wherein said plunger is axially slidable in said housing, said housing fixed to said projectile and located, at least in part, in said projectile fore section;

a spring means for biasing said plunger toward a forward slidable position in said housing;

means for limiting an extent of forward travel of said plunger; a firing pin fixed to said plunger and facing rearward; a percussion cap fixed to said housing, said cap mounted aft of said firing pin;

means for checking axial movement of said plunger rearward to prevent said plunger from striking said percussion cap while said projectile is in said case or under propulsive launch, said rearward movement checking means comprising at least one discardable insert interposed between a plunger face and a housing face, and adjacent to said case;

means for locking said plunger in a rearward seated position on said insert prior to firing said projectile;

means for freeing said plunger locking means after firing said projectile;

means for radially retaining said insert from discarding until propulsive acceleration of said projectile ceases, said retaining means including a retained member of said insert and a retaining member of said projectile overlapped to prevent radial discard of said insert while said plunger is set back on said insert under influence of acceleration;

means for freeing said insert from said radially retaining means upon full emergence of said projectile from said bore and a subsequent absence of propulsive acceleration, said freeing means including said spring means for moving said plunger forward to permit separation between said overlapped retaining projectile member and said retained insert member, a means for holding said insert to assure that relative axial movement is effected between said retaining projectile member and said retained insert member upon movement of said plunger forward;

means for discarding said insert after said insert freeing means is effected;

whereby, upon discard of said insert, said projectile is armed, and upon subsequent target impact of said projectile, said firing pin is forced rearward to impact and initiate said percussion cap which, in turn, initiates a charge of said projectile.

2. The device of claim 1 wherein said insert holding means is embodied in said housing;

wherein said retaining member of said projectile is embodied in said plunger.

3. The device of claim 1 wherein said insert holding means is embodied in said plunger;

wherein said retaining member of said projectile is embodied in said housing.

4. The device of claim 1 wherein means for radially retaining said insert further comprises:

a bore riding portion of said insert.

5. The device of claim 1 wherein said plunger locking means includes a radially emplaced ball within a through hole in a wall of said housing, a portion of said ball intruding radially inward into a depression of said plunger, said ball abutting said case to prevent radial movement of said ball outward, wherein said radially intruding ball portion precludes axial movement of said plunger;

wherein said plunger freeing means is an absence of radial bore restraint on said ball upon muzzle exit of said ball.

6. The device of claim 1 wherein said plunger locking means includes a discardable bore riding gripping member comprising coupled fore and aft grips cooperatively interfaced with said plunger and said housing to hold said plunger in a rearward seated position on said insert while said gripping member is under case or bore restraint;

wherein said plunger freeing means is an absence of bore restraint on said gripping member upon muzzle exit.

7. The device of claim 6 wherein said gripping member is joined with said insert.

8. The device of claim 1 wherein means for discarding said insert includes an extension member of said insert, extending forwardly to act as a lever for discarding said insert from said projectile upon influence of ram air during flight.

9. The device of claim 2 wherein means for discarding said insert includes an extension member of said insert, extending forwardly to act as a lever for discarding said insert from said projectile upon influence of ram air during flight;

wherein said plunger locking means includes a gripping member on said insert extension member, said gripping member cooperatively interfaced with said plunger to hold said plunger in a rearward seated position on said insert while under radial restraint by case or bore;

wherein said plunger freeing means includes a springy section of said extension member to permit said gripping member to move radially outward upon absence of bore restraint.

* * * * *